United States Patent [19]

Nandagiri et al.

[11] Patent Number: 4,546,905

[45] Date of Patent: Oct. 15, 1985

[54] AEROSOL DISPENSING SYSTEM

[75] Inventors: Arun Nandagiri, Dover; Richard G. S. Pong, Passaic Park, both of N.J.

[73] Assignee: American Cyanamid Co., Stamford, Conn.

[21] Appl. No.: 424,693

[22] Filed: Sep. 27, 1982

Related U.S. Application Data

[63] Continuation of Ser. No. 318,504, Nov. 5, 1981, abandoned, which is a continuation of Ser. No. 136,201, Apr. 1, 1980, abandoned.

[51] Int. Cl.[4] ..... B67D 5/58

[52] U.S. Cl. ..... 222/189; 222/402.1; 222/464

[58] Field of Search ..... 222/189, 211, 402.1, 222/402.18, 402.2, 464; 239/337, 340, 372; 55/159

[56] References Cited

U.S. PATENT DOCUMENTS

| | | | |
|---|---|---|---|
| 2,681,252 | 6/1954 | Tuttle | 239/337 |
| 2,995,278 | 8/1961 | Clapp | 239/337 |
| 3,260,421 | 7/1966 | Rabussier | 222/394 |
| 3,523,408 | 8/1970 | Rosenberg | 55/159 |
| 4,398,654 | 8/1983 | Pong et al. | 222/402.1 |

*Primary Examiner*—H. Grant Skaggs

*Attorney, Agent, or Firm*—Charles J. Fickey

[57] ABSTRACT

An aerosol dispensing device having a valve system enabling the container to be used in any orientation.

5 Claims, 2 Drawing Figures

AEROSOL DISPENSING SYSTEM

This is a continuation of application Ser. No. 318,504, filed Nov. 5, 1981, which is a continuation of Ser. No. 136,201, filed Apr. 1, 1980, both now abandoned.

The present invention relates to the dispensing of aerosol products using a porous eduction tube. More particularly, this invention will disclose an improved aerosol valve which operates uniformly regardless of the position in which it is held.

It is well known in the art to dispense pressurized compositions using conventional aerosol valves. These products are normally made up of a concentrate, and a propellant to expell the concentrate. Propellants used have been liquified gases such as propane, isobutane, n-butane, and mixtures thereof or compressed gases such as carbon dioxide, nitrogen, freon, etc. The valves that are used to dispense these products generally have a polyethylene eduction tube which extends to the bottom of the container and is open at the bottom. When the valve is actuated, the product and propellant travel up this polyethylene tube and are dispensed at a predetermined rate. In some cases a vapor tap on the valve is an added option to allow propellant vapor to mix with product before they are dispensed.

Although this valve design is used extensively in the aerosol industry it suffers from many disadvantages. One of the biggest disadvantages is noticed when the container is actuated in the inverted position. Since the open end of the dip tube then is above the product level and open to the vapor propellant in this inverted position, only propellant vapor enters the tube and is dispensed. In an attempt to alleviate this problem, valves have been proposed wherein, in the inserted position, the product travels through a vapor tap into the housing, and the vapor enters through the open end of the dip tube. Although these designs were fairly successful, they could not be employed when compressed gases such as carbon dioxide were used as the propellants. These compressed gases have limited solubility in the concentrate and when a vapor tap is provided, and the container is in the upright position, there is a rapid "bleed off" of the propellant vapor causing sudden drop in pressure, and eventually total loss of propellant before all of the product has been dispensed. This results in loss of the remaining product since it can no longer be dispensed from the container. Even when liquified gases such as isobutane and propane were used, this bleed off effect was noticible although not to the same extent. Examples of products that use carbon dioxide as the propellant and often are sprayed upright and inverted, are aerosol bathroom and toilet bowl cleaners. In this type of a product it becomes necessary to spray in an inverted position to clean hard to reach places. This is also true in dispensing food products such as whipped cream or oil for frying; and for medicaments or skin creams which may be applied when the person is lying down. Other attempts to alleviate this problem have resulted in complex valve designs with substantial cost increases.

Another disadvantage of conventional aerosol systems is a serious potential for clogging of the valve orifices by foreign particle matter which might be accidentally introduced into the formulation or the container. This is a major cause of dissatisfaction among users of aerosol products and it continues to persist even under strict quality control conditions. The past attempts to improve this problem have either not been successful or have been too complex to manufacture. U.S. Pat. No. 4,035,033 discloses an example of an invention to attempt to solve this clogging problem; wherein, a mesh filter is attached to the bottom of the eduction tube and the product is filtered before it is dispensed. However, the surface area of the mesh filter is relatively small, and the pressurized units do occasionally clog when there are a large number of foreign particles in the product. This is particularly noticeable in carbon dioxide propelled formulations wherein the orifice sizes have to be restricted to control product flow. In addition to clogging problems, valves with small orifices are difficult to manufacture and small changes in tolerances can cause wide variations in the dispensing of the product.

A further difficulty in the prior art has been where the particular materials to be dispensed are in the nature of immiscible liquids (one of which may be the propellant) which form separate or distinct and non-interspersed layers within the container, difficulty may be experienced in obtaining a simultaneous dispensing of both layers and/or a desirably homogeneous mixture thereof, especially if the immiscible materials are such as to resist interspersion or admixture by shaking or otherwise immediately prior to opening the dispensing valve. This is called a three phase system in which phase I is the upper layer of vaporized propellant, phase II is an intermeadiate layer of liquid propellant, and phase III is the lower layer of product.

Traditionally, an aerosol valve is fitted with a dip tube, extending into the product to be dispensed, through which the product flows into the valve body and through the stem and button. A vapor tap, which usually opens into the body of the valve, allowing propellant vapor to mix with the product stream, may be included in the device.

Hydrocarbons, for example, when mixed with a water-based product, tend to float on the surface thereof, since the two phases are immiscible. Technology is available to formulate hair spray concentrates or antiperspirants, and so forth, using water as a solvent. Heretofore, the difficulty with such systems has been dispensing them as aerosol sprays using conventional aerosol valves, which do not provide sufficient break up of the product concentrate, resulting in streaming rather than misting. Recent technology has shown that such products can be dispensed by making use of the hydrocarbon vapor. This has not been satisfactory, since spray rates are low, possibly because of the fact that the vapor may occupy most of the volume of the body of the valve.

Accordingly, it is a objective of this invention to provide a restriction for product flow which does not relate to orifice size.

Another objective of this invention is to provide a pressurized unit which is essentially non-clogging.

A further objective of the invention is to provide an aerosol package which operates uniformily regardless of the position in which it is held.

Still another object is to provide an aerosol package containing immiscible materials and for dispensing one or more of the materials. These and other advantages of this invention will become evident as the description proceeds.

The present invention is based on the use of an eduction tube which is closed at the bottom end and is porous only to the material to be dispensed. This invention has two major points of difference from prior art. While prior art makes use of an open ended eduction tube to draw the product into the valve housing, this invention does not have such a tube. In its place is a tube opening into the housing but which is closed on the bottom. The second major point of difference is that while prior art uses a tube which is non porous to all of the materials in the container, the tube used in the present invention is porous to the material to be dispensed and draws the product through the tube walls instead of through an opening in the bottom of the tube.

Numerous products may be dispensed with the aerosol container of the present invention.

Such products may be, for example hair sprays, antiperspirants, deodorants, shaving creams, space deodorizers, bathroom and other cleaners, aerosol paints, food products, skin lotions, and the like.

The invention may be better understood by reference to the drawings in which.

Figure 1:
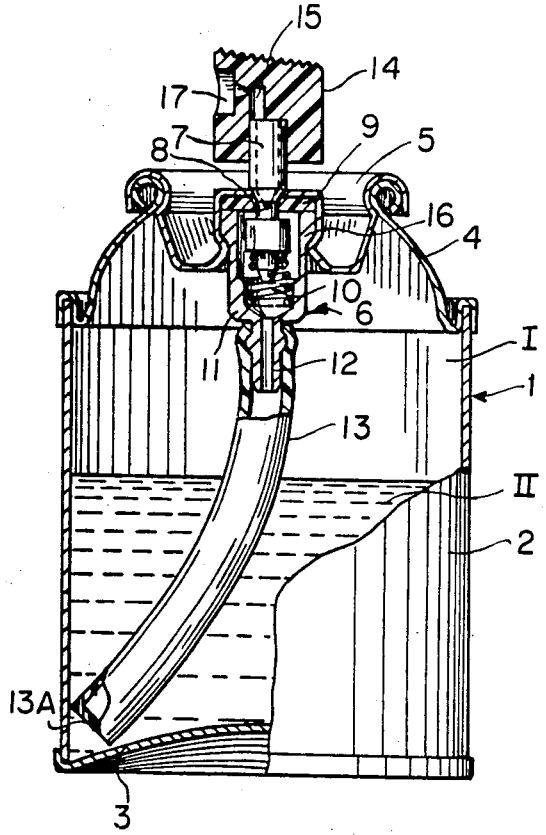
FIG. 1 is a side sectional diagramatic view of an aerosol container according to the invention having a two phase product/propellant system.

Referring to FIG. 1, a two phase aerosol system is shown according to the invention having container 1 with body 2, bottom 3, collar 4 and top 5. A valve member 6 fits into top 5. The contents of container 1 are divided into two phases, an upper phase I and a lower phase II. Phase II consists of a liquid phase containing the product to be dispensed. Phase II may be propellant which is a vapor under atmosphere pressure and in which the product to be dispensed is dissolved or admixed. Phase I is then vaporized propellant. On the other hand, phase I may be a propellant gas such as $CO_2$ and phase II is a liquid product or is liquid having a product dispersed or dissolved therein. Valve member 6 comprises a hollow stem with the valve 8 normally seated against gasket 9 by means of spring 10. Surrounding the valve is a housing 11 with a tailpiece 12 to which a porous plastic flexible dip tube 13 is attached. The porous plastic dip tube 13 is closed at the lower end 13A, which may be done during formation, or by crimping, or with a suitable plug or cap. Dip tube 13 is formulated of a material and with a porosity to allow only the fluid phase to pass through the walls of the tube and not the gaseous phase. The valve stem 7 has actuator or head 14 mounted thereon with passageway 15 therethrough. When actuated by pressing down head 14, the valve 8 is moved downward to open into interior cavity 16 of valve body 11. Since vapor phase I and liquid phase II are under superatmospheric pressure, fluid is forced through the walls and up dip tube 13 into passageway 15. The liquid becomes vaporized and leaves head orifice 17 as a fine spray. Since the porous tube 13 allows passage of liquid product only, it is an effective gas barrier. This is an important attribute of the porous tube which makes it very useful and different from conventional aerosol valves. The large surface area of the tube exposed to the product makes it a very effective filter media, and prevents or reduces incidences of clogging of the orifices by foreign particle matter. The pore sizes and density on porous tube 13 can be varied to suit particular product needs. Ideally, in all aerosol products the orifices on the valve should be used to control the flow of the product. However, in products where lowering the orifice sizes below a certain range causes too much variation, the porous dip tube can be used as an effective flow constrictor. This application is particularly useful in $CO_2$ propelled systems where the flow of product can be controlled only to a certain extent below which the orifices become too small and cause variations in spray.

Figure 2:
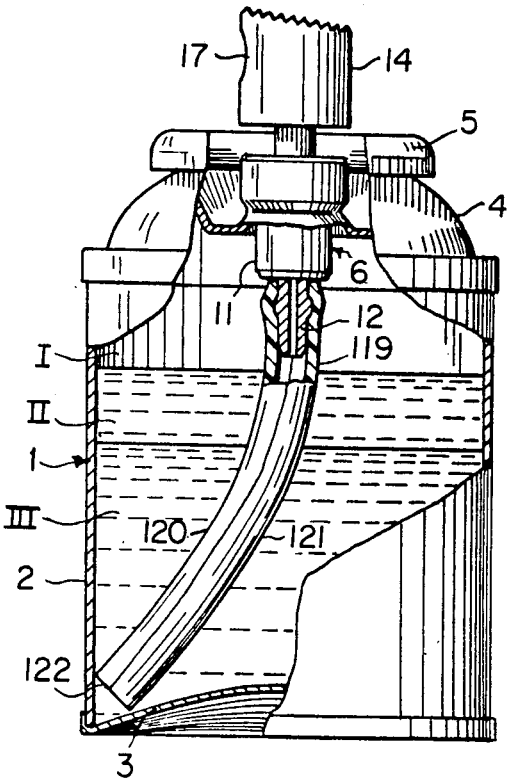
FIG. 2 is a side sectional diagramatic view of an aerosol container according to the invention having a three phase product/propellant system.

In FIG. 2 is shown an aerosol container 1 generally of the same type as that shown in FIG. 1, having a three phase product system. Such a system is under superatmospheric pressure and may comprise, for example phase I as vaporized propellant, phase II as liquified propellant and phase III as liquid product not miscible with the propellant and which is heavier than the liquified propellant. For example, the propellant may be a hydrocarbon, e.g. butane and the product may be a water based hair spray. In a system such as this, the porous tube material is such that it allows only one of the phases to pass through. For example, hydrophobic materials such as porous polyethylene would allow the hydrocarbon phase to pass through in preference to the water based concentrate. Similarly, materials which are hydrophyllic allow water based products to pass through. By making a porous tube which is coextruded with the two different materials, one of which is hydrophobic, and the other hydrophyllic, it would be able to dispense both these phases simultaneously which was hitherto not possible when a non porous polyethylene tube was used. In FIG. 2, dip tube 119 is shown coextruded from two different plastic materials to form a tube which is hydrophobic on one side 120 and hydrophyllic on the other side 121. Dip tube 119 is closed at lower end 122.

In this instance, both phases II and III will pass through porous tube 119 and be dispensed. However, when dip tube 119 is formed from a single plastic material, it may be porous either to phase II or phase III and that phase would pass through and be dispensed.

It will be clear that many variations of product and propellant may be combined in the present invention.

Following are Examples of formulations which may be dispensed in the inventive container and valve assembly of the present invention.

| | % w/w |
|---|---|
| **Example I** | |
| **Insecticide** | |
| Pyrethrins | 0.25 |
| Piperonyl Butoxide | 1.25 |
| Fragrance | 0.20 |
| Petroleum Distillate | 1.25 |
| Deionized Water | 67.05 |
| Isobutane | 30.00 |
| | 100.00 |
| **Example II** | |
| **Space Deodorant** | |
| Perfume | 1.50 |
| Deionized Water | 73.50 |
| Isobutane | 25.00 |
| | 100.00 |
| **Example III** | |
| **Antiperspirant** | |
| Aluminum Chlorhydrol (Water Soluble) | 15.00 |
| Perfume | 0.50 |
| Deionized Water | 44.50 |
| Isobutane | 25.00 |
| Alcohol 190 Proof | 15.00 |
| | 100.00 |
| **Example IV** | |
| **Deodorant** | |

-continued

| | % w/w |
|---|---|
| Alcohol 190 Proof | 20.00 |
| Perfume | 1.50 |
| Deionized Water | 53.50 |
| Isobutane | 25.00 |
| | 100.00 |

Example V
Hair Spray

| | |
|---|---|
| Alcohol 190 Proof | 43.72 |
| Gantrez LS 225 | 6.00 |
| A.M.P. | 0.13 |
| Deionized Water | 25.00 |
| Perfume | 0.15 |
| Isobutane | 25.00 |
| | 100.00 |

Example VI
Hair Spray $CO_2$ Dispensed

| | |
|---|---|
| Alcohol SD40 200 Proof | q.s. |
| Gantrez ES 225 | 6.00 |
| AMP | 0.13 |
| Perfume | 0.15 |
| $CO_2$ to 100 psig | 5.00 |
| | 100.00 |

Example VII
Hair Spray - 2 Phase System

| | |
|---|---|
| Alcohol SD40 200 Proof | q.s. |
| Gantrez ES 225 | 6.00 |
| AMP | 0.13 |
| Deionized Water | 8.00 |
| Perfume | 0.15 |
| Isobutane | 25.00 |
| | 100.00 |

We claim:

1. An aerosol package comprising a container under pressure a vaporized propellant and a liquified product, said propellant and product being present as at least two separate phases, and a valve means comprising a valve having a single inlet enclosed by a hollow, porous plastic diptube extending to the base of said container, said diptube being closed at the bottom, said dip-tube and closed bottom thereof being impervious to said vaporized propellant, and substantially void of any filler material therein, whereby said diptube permits unobstructed flow therethrough and the container can be positioned for use in any orientation.

2. An aerosol package as in claim 1 wherein said product is miscible in a liquified portion of said propellant.

3. An aerosol package as in claim 1 wherein said propellant is present as a vapor phase and liquid phase, and said product is present as a second liquid phase immiscible with said liquified vapor phase.

4. An aerosol package as in claim 3 wherein said product has ingredients in both said liquified vapor phase and said second immiscible liquid phase.

5. An aerosol package as in claim 1 containing two immiscible liquid phases, with product in at least one liquid phase, and said dip tube is porous to both said liquid phases.

* * * * *